US011401691B2

(12) United States Patent
Westergaard

(10) Patent No.: US 11,401,691 B2
(45) Date of Patent: Aug. 2, 2022

(54) HYDRAULIC ARRANGEMENT

(71) Applicant: Danfoss Power Solutions GmbH & Co. OHG, Neumünster (DE)

(72) Inventor: Erik Westergaard, Nordborg (DK)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 0 days.

(21) Appl. No.: 17/222,084

(22) Filed: Apr. 5, 2021

(65) Prior Publication Data

US 2021/0317634 A1 Oct. 14, 2021

(30) Foreign Application Priority Data

Apr. 14, 2020 (DE) ..... 102020110186.4

(51) Int. Cl.
*E02F 9/22* (2006.01)

(52) U.S. Cl.
CPC ..... *E02F 9/22* (2013.01)

(58) Field of Classification Search
CPC . E02F 9/22; E02F 9/2203; E02F 3/433; B66F 17/003; B66F 9/122
See application file for complete search history.

(56) References Cited

U.S. PATENT DOCUMENTS 4,382,743 A * 5/1983 Newell ..... B66F 9/122 212/231
6,092,976 A * 7/2000 Kamiya ..... B66F 9/22 414/636
6,125,970 A * 10/2000 Takeuchi ..... B66F 9/22 187/223
6,233,511 B1 5/2001 Berger et al.
6,705,826 B1 * 3/2004 Callens ..... B66F 9/065 414/686
6,763,619 B2 7/2004 Hendron et al.
8,996,259 B2 * 3/2015 Kaneko ..... F02D 41/021 701/50
9,822,507 B2 11/2017 Singh et al.
2005/0210713 A1 9/2005 Mennen et al.
2014/0107841 A1 4/2014 Danko

FOREIGN PATENT DOCUMENTS

CN 110088406 A 8/2019
CN 215948298 U 3/2022

* cited by examiner

*Primary Examiner* — Abiy Teka
(74) *Attorney, Agent, or Firm* — McCormick, Paulding & Huber PLLC

(57) ABSTRACT

The invention relates to a method (100) of operating an actuator arrangement including at least two types of actuators (6, 7, 11, 12, 30, 34) effectuating different types of movement of a connected device (10, 32) to be actuated, where a change of attitude of the connected device (10, 32) has an influence on the position of at least a defined part (13, 14) of the connected device (10, 32). Different types of actuators (6, 7, 11, 12, 30, 34) are actuated in an automated way to at least partly compensate for the change of position of the defined part (13, 14) of the connected device (10, 32) when changing the attitude of the connected device (10, 32), at least for a certain range of movements.

23 Claims, 4 Drawing Sheets

HYDRAULIC ARRANGEMENT

CROSS-REFERENCE TO RELATED APPLICATION

This application claims foreign priority benefits under 35 U.S.C. § 119 to German Patent Application No. 102020110186.4 filed on Apr. 14, 2020, the content of which is hereby incorporated by reference in its entirety.

TECHNICAL FIELD

The invention relates to a method of operating an actuator arrangement. Furthermore, the invention relates to a controller device, to an actuator arrangement and to a working vehicle.

BACKGROUND

Whenever bulk material is to be handled in huge quantities, in particular in mines, construction sites, quarries, agriculture and storage sites using huge piles (just to name some examples), telescopic handlers, telehandlers, telescopic wheel loaders, wheel loaders and the like are widely employed types of machinery. In particular, they can be used without any major infrastructure. Therefore, they can be used much more flexible and in areas, where fixed constructions like gantry cranes, big hoppers, underground bunkers or the like are not sensible to be used—despite of their intrinsic advantages.

The very basic structure of such telescopic handlers, telescopic wheel loaders and general wheel loaders is that they have a movable vehicle chassis on wheels and sometimes on crawler chains. Attached to the vehicle chassis is an arrangement of levers and booms that is pivotably attached to the vehicle chassis. Typically, the arrangement of levers is operated using hydraulic pistons, albeit in principle different actuators can be used as well. Movement of the actuators (like hydraulic pistons) results in an upward and downward movement of the parts of the arrangement of levers that are attached opposite of the hinge point. Here, usually a tiltable device is attached, like a shovel, a bucket, a fork or the like. By tilting the shovel/bucket/fork (or different device), the material to be moved can be either contained in/held at the device in a way that a movement of the vehicle is possible without losing the goods, or in a way that the goods are released. As an example, in case of a bucket, the bucket can be placed in a recess-like position so that gravel or other types of solid bulk freight can be moved around. By tilting the bucket, the gravel can be poured out at its destination place. This can be a truck, a lorry, a railroad car, a pile of solid bulk freight and/or the like.

It is needless to say that such vehicles are very widespread and are employed successfully in a wide area of technical fields. Consequently, the production of such machinery is an interesting economical field.

However, standard machinery requires well-trained operators. The problem is that due to the design and arrangement of the machine, the actuation of the various actuators does not only have the desired influence on the directly actuated parts of the machinery, in particular of the bucket or the like. Instead, usually side effects, causing different and undesired types of movement can be observed. So far, these side-effects have to be either tolerated and/or have to be compensated by an appropriate manual actuation of the machinery by well skilled personnel.

To give an example: if the bucket of a telescopic wheel loader is tilted, so that the bulk goods that are contained in the bucket are to be poured out into the loading area of a lorry, a tilting movement of the bucket that is commanded by an operator will typically also lead to a (usually) unwanted downward movement of the front part (blade edge) of the bucket. This could lead to a mechanical contact between the bucket and the lorry, potentially causing damage. Therefore, the operator of the wheel loader has to compensate this effect by an appropriate actuation of the lifting/lowering lever.

Even further, a tilting movement of the bucket also leads to a backward/forward movement of the releasing edge (blade edge) of the bucket as well. In particular when trucks/lorries that are admitted on standard roads (and which therefore have a comparatively small width of about 2.5 m, depending on national legislation) are to be loaded, this effect can easily lead to an asymmetric loading of the truck (and consequently adverse and even dangerous driving characteristics can occur). Also, the cargo bay of the lorry can be easily missed during the release of the material, so that a certain fraction of the released material falls down at a side of the lorry. Therefore, this backward/forward movement has to be compensated by the operator by appropriately actuating a forward or backward movement of the vehicle.

Even further, since driving the various hydraulic devices and actuators requires sufficient power, with nowadays machinery the operator usually even has to apply more or less power to the combustion engine (which is the typical energy source for such vehicles).

It is clear that such an orchestrated application of various settings of different levers and pedals is not an easy task to do and requires lengthy training and sufficient experience by the operator. Even then, the operator is prone to exhaustion after comparatively short time spans. Also, even well-trained operators do make erroneous input which can lead to a spill of bulk goods, necessary corrective movement of already loaded goods and even a damage of machinery.

In the prior art, several suggestions were already made to ease the complicated work for the operators of such machinery with an additional focus to avoid accidents.

As an example, U.S. Pat. No. 6,233,511 B1 suggests to use an electronic digital controller in connection with a loader that includes conventional mechanical components. The hydraulic valves are electronically controlled in a way that when the operator commands to raise or lower the bucket of a tractor, the controller rolls the bucket in a way to maintain a substantially constant angle between the bucket and the loader's frame (i.e. to maintain a constant attitude of the bucket). U.S. Pat. No. 9,822,507 B2 and U.S. Pat. No. 6,763,619 B2 follow a similar approach.

While such approaches are admittedly already quite helpful, they do not address the issue of problems being associated when actuating a tilting movement of a shovel or any other device attached to the assembly of levers (i.e. when changing the attitude of the connected device).

These and other problems can be solved when employing the present idea.

SUMMARY

It is therefore an object of the present application to suggest a method of operating an actuator arrangement comprising at least two types of actuators effectuating different types of movement of the connected device to be actuated, where the change of attitude and/or the position of the connected device has an influence on the position of at least a defined part of the connected device, where the method is improved over previously known methods of operating an actuated arrangement of this type.

It is another object of the present invention to suggest a controller device that is improved over controller devices that are known in the state-of-the-art. Yet another object of the invention is to suggest an actuator arrangement that is improved over actuator arrangements that are known in the state of the art. Even another object of the present invention is to suggest a working vehicle that is improved over working vehicles that are known in the state-of-the-art.

It is suggested to employ a method of operating an actuator arrangement comprising at least two types of actuators effectuating different types of movement of a connected device to be actuated, where a change of attitude and/or position of the connected device has an influence on the position of at least a defined part of the connected device in a way that the different types of actuators are actuated in an automated way to at least partly compensate for the change of position of the defined part of the connected device when changing the attitude and/or the position of the connected device, at least for a certain range of movement. When talking about "a change of position", one possibly has to differentiate between an intended change of position/input change of position/actuated change of position/desired change of position, and an unintended change of position/output change of position/un-commanded change of position/unintentional change of position/side effect change of position/consequential change of position.

When talking about actuators, it is to be noted that a type of actuator may comprise one, two or even more individual actuators. The way, how the different types of actuators are designed is essentially arbitrary. Just to name some examples, hydraulic pistons, electric motors, linear motors, combustion engines, hydraulic motors, rack wheels or the like may be employed, possibly even in combination. When talking about a type of movement, a linear movement and/or a rotational movement and/or different directions (possibly directions that are orthogonally arranged) might be considered, possibly even in combination. The type of movement may be considered with respect to an external reference frame, but also with respect to the output side of another type of actuator. Therefore, just to name an example, if a linear actuator is attached to another type of actuator, the direction of the linear motion might change in dependence of the position of the previous (or possibly even the plurality of previous) actuators. It is even possible that due to a pivotal movement of one or more previous actuators, even a linear actuator may show a rotational aspect of movement with respect to an external reference frame. As a connected device, a bucket, a shovel, a fork, a grip device or any other type of device may be considered. Usually the connected device is essentially the final device, effectuation the function, the actuator arrangement is designed for. Therefore, in case of a teleloader for moving gravel, the connected device will usually be a bucket for gravel. However, different types of devices may be considered as well. Usually, the connected device will be the last device in the chain of actuators. In other words, the connected device is usually not another actuator and/or a device that itself can be moved to move one or more actuators or other devices. The defined part of the connected device will usually be chosen depending on the purpose of the (full) actuator arrangement and/or of the connected device. For the definition of the defined part of the connected device, external devices that do not form part of the actuator arrangement, but which are defined by the purpose the actuator arrangement, may play a role as well. As an example, in case of a bucket wheel loader, the defined part of the connected device might be the blade edge of the bucket. However, one might consider a position that is somewhat displaced from the blade edge of the bucket as well. This might be due to a situation where the bucket is used for loading a truck or lorry. Since the blade edge will usually be arranged in the middle of the loading area of the truck/lorry when unloading the bucket, the defined part of the connected device might be a position of the bucket, which is displaced from the blade edge of the bucket by a certain fraction of the width of the loading area of the truck's/lorry's loading area, for example by approximately 50% thereof. This is based on the consideration that this might be the most critical region, where the bucket and the side walls of the loading area will come closest to each other and/or were a sufficient separation has to be ensured. The limitation to the "certain range of movement", where the compensation is performed, might simply relate to mechanical limitations of the actuator arrangement. This does not only relate to the possibility that compensation is not performed, when a mechanical end stop is reached. Instead, it is also possible that a compensation stops or is reduced once the actuator arrangement comes close to a mechanical end stop. "Close" can mean that a distance of 10%, 9%, 8%, 7%, 6%, 5%, 4%, 3%, 2% or 1% of the available moving range for the respective actuator as seen from the respective end point has been reached or undershot. A "reduced compensation" can mean a reduction of the compensation to 90%, 80%, 70%, 60%, 50%, 40%, 30%, 20% or 10% of the normal compensation. In particular, it is possible to implement a varying fractional value that depends on the distance from the mechanical end stop. As an example, at a position 10% away from the mechanical end stop the compensation is still 100%. However, at 9% distance, the compensation is reduced to 90% and so on, until at 0% distance of the mechanical end stop, the compensation is reduced to 0% (which is so to say consistent with the mechanical end stop). Additionally or alternatively, however, it is possible to define a "certain range of movement" in a way that compensation is only performed in (a range of) positions of the actuated arrangement, where such a compensation scheme seems to be feasible. This (and the aforementioned) limitation can be implemented at the factory of the actuated arrangement, by service personnel, by the employer or even by the operator himself. As an example: the compensation might only be performed in an elevated position of the boom, which is a typical position when a shovel has to be unloaded into a truck/lorry. "Elevated" can mean that the upward/downward actuator is at a position of at least 30%, 40%, 50%, 60%, 70% or 80% from its lowermost position. All indicated numbers may be used as a lower and/or upper border for an interval, as well (including 0% and 100%, where sensible).

The compensation of the change of position of the defined part of the connected device when a change of attitude and/or position of the connected device is commanded is done in an automated way. This automated way can be realised by virtue of an appropriate mechanical design and/or by virtue of the application of correction signals to the actuators. In particular, it is possible to generate modified control signals, using a controller device, in particular an electronic controller device and/or a programmable controller device. In particular a computer device, like an electronic controller, including single circuit boards, may be used for this. It is also possible that the method is implemented on a controlling device that is already present for the control of the actuated arrangement. This does not rule out the possibility that the performance of the respective controller device might have to be chosen somewhat larger, to implement the additional functionality of the presently proposed method. Preferably, the presently proposed compensation is done in full (100%). However, it is also possible that only a partial compensation is realised. A partial compensation can be understood in a way that only a certain direction and/or degree of movement (or in only two, three or a plurality of certain directions and/or degrees of freedom of movement) is compensated and/or that the compensation of a certain direction and/or degree of movement (or of two, three or a plurality of certain directions and/or degrees of freedom of movement) is only performed in part (for example to at most 90%, 80%, 70%, 60%, 50%, 40%, 30%, 20%, 10%). On the contrary, it might be helpful as well to use an overcompensation, for example of (up to/not less than) 110%, 120%, 130%, 140%, 150%, 160%, 170%, 180%, 190%, 200%, 250%, 300%, 350%, 400%, 450% or 500%. The amount might be chosen by the manufacturer, by a servicing mechanics, by the employer and/or by the operator himself. In particular it is to be noted that a person who is accustomed to compensate for any lateral and/or rotational deviations due to the previously described "side-effects of movement" manually, the behaviour of the presently proposed method of operating an actuated arrangement might be surprising and/or even counter-productive for him, meaning that the combination of automated compensation and manual compensation (the operator is used to) might lead to damage because of a "double compensation". Using such an individually selectable percentage of compensation might be helpful to fade out the correcting behaviour of present-day skilled operators. Additionally and/or alternatively, it is possible that the amount of the at least partial compensation might depend on certain ranges of movement. Therefore, compensation may be realised for a certain range of movements, while no compensation is performed anymore (or a compensation at a reduced level) when this range is left. This can be done based on whatever consideration, for example by considering the mechanical ability of movements of the connected device.

The described situation of an actuator arrangement, where a change of attitude and/or position of the connected device has an influence on the position of at least a defined part of the connected device occurs in a plethora of basic designs and/or technical applications. Essentially, such a situation can occur if the respective actuators do not solely initiate a movement in directions that are arranged orthogonally to each other. Therefore, this situation can occur if two actuators perform a linear movement in directions that are not arranged perpendicular to each other. Also, the described influence will usually occur if an actuator initiates a pivotal movement/turning movement/rotational movement. The unintended movement, i.e. usually a change of the position of at least a defined part of the connected device, can depend on the angular position/attitude of the connected device. Quite often some kind of a sinusoidal/cosinusoidal dependence does occur. Regularly, the described dependence occurs if the various actuators are arranged as some kind of an arrangement in series. That is the case, if two (or more) actuators are not connected to the same frame, but instead are arranged in a way that a second (or later) actuator is moved together with the movement of the first (or another one of the "earlier" actuator(s)). This is the case, if so to say an input side of one type of actuator (possibly a first, second, third or other actuator) is connected to a basic or earlier system (for example a vehicle chassis and/or ambient surroundings and/or other actuators), while another (second, third, fourth, and/or later) actuator is connected with its input side to the output side of another actuator (earlier actuator; first actuator). The same can apply mutatis mutandis to even more actuators. In case of a movable vehicle, the second actuator can be connected to a vehicle chassis, where the vehicle chassis is so to say the output side of the first actuator, where the first actuator may be considered to be the driving platform/hydraulic motor of the vehicle. Therefore, in this case the input side of the first actuator may be considered to be an external reference frame, i.e. the surroundings.

A detailed example for this would be a teleloader (or telehandler), where the first actuator can be considered to be the driving motor of the vehicle. Then, the surroundings would be the input side of the first actuator, while the vehicle chassis would be the output side of the first actuator, the first actuator being the driving engine/driving actuator (for example a hydraulic motor) of the teleloader. Connected to the output side of the first actuator is another actuator (second actuator), presently a hydraulic piston (or even a plurality of hydraulic pistons). The hydraulic pistons are intended to effectuate an upward/downward movement of the distant part of the arrangement of (lifting) levers (or (lifting) rods) that is moved by the (lifting) hydraulic pistons. The vehicle chassis is the input side for the second actuator, while the angle of (and therefore the distant end of) the arrangement of (lifting) levers may be considered to be the output side of the second actuator (lifting actuator). As it is clear for a person skilled in the art, an upward and downward movement (variation of angle) of the arrangement of levers is the main and intended output movement of the (lifting) hydraulic piston(s) (second actuator). Nevertheless, due to the hinged attachment of the arrangement of levers to the vehicle's chassis, and therefore the pivotal movement thereof, a variation in angle/an upward and downward movement of the distant end of the arrangement of levers (opposite the pivoting point) also results in a usually less pronounced forward and backward movement of the (distant) end of the arrangement of levers with respect to the external reference frame. Connected to the distant ends of the lifting levers, a rotatable bucket may be attached. The rotation may be effectuated by a third (or fourth; see below) actuator, where the (attitude) actuator can be a hydraulic piston as well. For mechanical reasons, the rotational axis of the bucket is usually placed somewhat close to the centre of gravity, when the bucket is filled with the goods, it is provided for. As a consequence of this, the blade edge of the bucket will perform an upward and/or downward movement, as well as a backward and/or forward movement, when the bucket is rotated. The amount of upward/downward movement versus forward/backward movement of the bucket's blade edge per unit rotation depends on the (angular) position of the bucket. Typically, a somewhat sinusoidal/co-sinusoidal dependence is present. When being in the essentially horizontal position, the upward/downward movement will be more pronounced, while the forward/backward movement of the blade edge will be somewhat small, while the situation reverses for a vertical position of the bucket. Possibly, the lifting levers (lifting rods) are designed to be extendable, using a suitable actuator (for example a hydraulic piston; a motor driving a cog that engages in a cog rail; or any other type of suitable actuator). Since this actuator is arranged between the second actuator (lifting hydraulic piston(s)) and the (then) fourth actuator (rotating actuator(s)), when seen in the chain of actuators, this third actuator is connected with its input side to the output side of the second actuator, while the output side of the third actuator is connected to the input side of the (then)

fourth actuator. A change of the length of the lifting levers will have an effect on the height of the (defined part of the) connected device, as well as on the lateral position (forward/backward position) of the (defined part of the) connected device. This mainly depends on the current angular position of the lifting levers (typically sinusoidal and/or co-sinusoidal dependence). Therefore, this third actuator, if present, can usually at least partially compensate for any height variation and/or forward/backward variation of the (defined part of the) connected device. This possibility might be limited to certain ranges of the settings of the various (other) actuators. Certainly, if an extension/retraction of the lifting lever is not provided, this type of compensation is not possible.

It is suggested to employ the method in a way that the attitude of the connected device is primarily determined by the setting of an attitude actuator, wherein the setting of the attitude actuator usually has an influence on the position of the defined part of the connected device, as well. In other words, the setting of the attitude of the connected device is primarily defined by the setting of a dedicated actuator, namely an attitude actuator. Nevertheless, the attitude of the connected device is usually also additionally influenced, at least to a certain extent, by the setting of one or more different types of actuators, in particular of actuators which are placed before the attitude actuator in the chain of actuators. Quite often, the attitude actuator will be the last actuator in the chain of actuators, although this is not necessarily mandatory. The position of the attitude actuator, in particular the position of the defined part of the connected device, is usually mainly determined by one or more types of actuators, that are different from the attitude actuator. However, like previously described, the setting of the attitude actuator might have an influence on the position of the defined part of the connected device, at least to a certain extent, as well. In this context, reference is made to the previously given example of a teleloader with a rotatable bucket for solid bulk material.

In particular in this context, it is to be noted that an influence on one or a plurality of types of actuators might be due to external effects as well. Just to give an example, a driving engine of the vehicle frame of a teleloader will at first sight influence a forward/backward position of the connected device, only. If the teleloader is positioned on a straight slope, however, driving the vehicle's chassis forward and backward will influence the height of the connected device as well (with respect to the external reference frame). Even further, if the teleloader is moved along a curved slope (varying grade thereof), a forward/backward movement of the vehicle's chassis will even have an influence on the attitude of the connected device.

Even further, it is suggested that at least some of the actuators are hydraulic actuators, in particular hydraulic pistons and/or hydraulic motors and/or it is suggested that at least one of said actuators is a driving actuator of a vehicle. Such actuators have proven to be very reliable and perform the required aspects of movement particularly well. Furthermore, such actuators are widely available so that the method can be easily employed, using standard actuators. It is even possible to use the presently proposed method as some kind of a software upgrade (or hardware upgrade, if an additional controller and/or improved controller or the like is required), even for existent machinery.

It is further suggested to employ the method in a way that the connected device is a shovel, a fork, a bucket and/or a grasping device and/or in that the actuated arrangement forms part of a shovel dozer, wheel loader, telescopic wheel loader, teleloader, backhoe loader, an excavator and/or a forklift truck. In this case, the presently proposed method can show its intrinsic advantages and properties particularly well. Determination (possibly of the type and/or size etc.) of the connected device may be performed automatically and/or by an operator input. An automatic determination might be realised by some mechanical coding of the connected device, an optical recognition system, a RFID recognition system (where the connected device has to bear an appropriate transmitter), and the like. Even in case an automated recognition system is provided, an additional manual input possibility is nevertheless sensible. Manual input might be used as an override in case the automatic system delivers a wrong output or shows a malfunction. Further, manual input is sensible in case the connected device cannot be recognised by the automatic system, for example because it does not have an RFID transmitter, doesn't have a mechanical coding system, or the like). The notion "determination of the connected device" can not only relate to the type of device that is attached (for example a fork, a shovel, bucket and so on), but also to its size (height, width, length etc) and/or details about its (external) dimensions or the like.

Even further, it is suggested that the defined part of the connected device is located near (or at) a bottom side of the connected device and/is located near (or at) a front section of the connected device, preferably opposite of a connection section and/or a hinge device of the connected device and the actuated arrangement and/or is located with a displacement from a front section of the connected device, preferably opposite of a connection section and/or a hinge device of the connected device and the actuated arrangement and/or is located with a displacement from the connection section and/or the hinge device of the connected device and the actuated arrangement. As it is clear from the already given example of a teleloader, these parts are usually the most critical parts, where a damage can quite likely occur and/or a certain separation has to be employed and/or where the versatility of the actuated arrangement can be increased, in particular. The displacement (offset) from the front section of the connected device can be expressed as an absolute value (for example 10 cm, 20 cm, 30 cm, 40 cm, 50 cm, 75 cm, 1 m, 1.25 m, 1.5 m, 1.75 m or 2 m). Also, the displacement (offset) from the front section can be expressed as a relative value, in particular as a fraction of the length/lengthwise extent (or a different value that indicates the size and/or type and/or geometrical characteristics of the connected part), for example 10%, 20%, 30%, 40%, 50%, 60%, 70%, 80% or 90% displacement from the front section, relating to the value used for describing the connected part. To give an example: if a shovel with a length of 2 m is used as a connected device, the respective number could be 0.2 m, 0.4 m, 0.6 m, 0.8 m, 1 m, 1.2 m, 1.4 m, 1.6 m or 1.8 m. The aforesaid applies mutatis mutandis for a displacement from the connection section and/or the hinge device of the connected device and the actuated arrangement. All indicated numbers may be used as a lower and/or an upper border for an interval, as well (including 0% and 100%, where sensible).

Preferably, the defined part of the connected device is chosen in dependence of the connected device. Again, the choice can be made automatically and/or manually (for example by operator input). The choice can relate to the geometrical location (for example by choosing the bottom side of the connected device), and/or can relate to the (lengthwise) position of the defined part with respect to the extent of the connected device (for example location of the respective part near or at the front section of the connected device, or with a certain displacement from the front section of the connected device or from the connection section/hinge device).

Even further, it is suggested that the range for corrections and/or the direction of corrections is limited for certain actuators, in particular for safety reasons. Additionally and/or alternatively it is suggested that corrections of at least certain actuators are only allowed under certain conditions and/or on condition of an express clearance and/or on condition of a certain sensor input and/or on condition of a certain data output and/or in certain areas and/or locations. As an example, a corrective rearward movement of the teleloader, while the content of a bucket is dumped into a lorry, might be problematic from a safety aspect, since this is sort of equivalent to an "un-commanded" backward movement of the vehicle. This is particularly the case when the operator of the actuated arrangement is not yet accustomed to the presently proposed corrective behaviour. Therefore, it might prove to be advantageous to block an "un-commanded" backward movement, or to at least limit the distance of such an "un-commanded" backward movement. It is to be mentioned that in case the lifting levers are designed to be extensible/retractable, commanding an extension/contraction of the lifting lever is usually the preferred way of compensation. However, this might not be possible (in full) in certain positions of the actuator arrangement. However, such a backward movement might nevertheless be allowed in certain areas (for example in a quarry where only skilled personnel is present, and where the personnel may be easily instructed to maintain a certain distance from operating machinery (an instruction that is usually already given) and/or if an operator pressed a clearance button for such an automated backward movement, after he verified that the rearward area of the vehicle is clear. This might be done in of automated way as well, for example in that distance sensors are used. If such distance sensors show that the rearward area of the teleloader is clear, an automated backward movement is allowed. It is to be noted that this is just an express example. In particular, different directions (in particular a forward movement of a teleloader) and/or different types of machinery (apart from a teleloader) might use the presently described embodiment as well.

In particular it is suggested to employ the method in a way that the method is applied only on request, in particular on request of an operator and/or it is suggested that the method is deactivated on request, in particular on request of an operator. This request (possibly of an operator) may be of a binary on/off type. However, it may be also made with respect to certain directions of corrections/types of movement (like previously described, i.e. possibly with respect to rearward and/or a forward movement (of the machinery)). Also, it might be employed on a "percentage level", so that a compensation is only made to a certain percentage, as initially described with respect to a teleloader already. Also, and absolute limit might be set. As an example, the maximum backward driving distance might be set to 50 cm (unless a special clearance is issued by the operator, as an example). For completeness it should be mentioned that the various aspects of such a request may be combined partially and/or fully as well.

Furthermore, it is suggested to employ the method in a way that the main input is made by an operator, in particular by a human operator and/or an autonomous driving logic, wherein the main input is modified using a method according to the previous suggestions. The human operator might be sitting in/on the machinery, or might operate the machinery via a remote control. A combination of human control and autonomous driving may be employed in particular in case of a remote control arrangement, where the human operator possibly indicates only the destination or certain aspects of the driving path, while the autonomous driving logic fills in the "missing" commands.

Further, a controller device is suggested that is designed and arranged to perform a method according to the previous suggestions. The respective controller device may be modified in the previously described sense as well. Usually, such a controller device will show the same advantages and effects as previously described, at least in analogy. In particular, the controller device can be an electronic controller device.

Furthermore, an actuated arrangement is suggested that comprises a plurality of actuators and a controller device of the afore described type. This way, the actuated arrangement can show the same advantages and effects as previously described, at least in analogy. Furthermore, the actuator arrangement can be modified in the previously described sense as well, at least in analogy.

Even further, a working vehicle is suggested that comprises an actuated arrangement according to the aforementioned type. This way, a working vehicle can be realised that shows the aforementioned effects and advantages, at least in analogy. Also, the working vehicle can be modified in the previously described sense as well, at least in analogy.

BRIEF DESCRIPTION OF THE DRAWINGS

Further advantages, features, and objects of the invention will be apparent from the following detailed description of the invention in conjunction with the associated drawings, wherein the drawings show.

DETAILED DESCRIPTION

Figure 1:
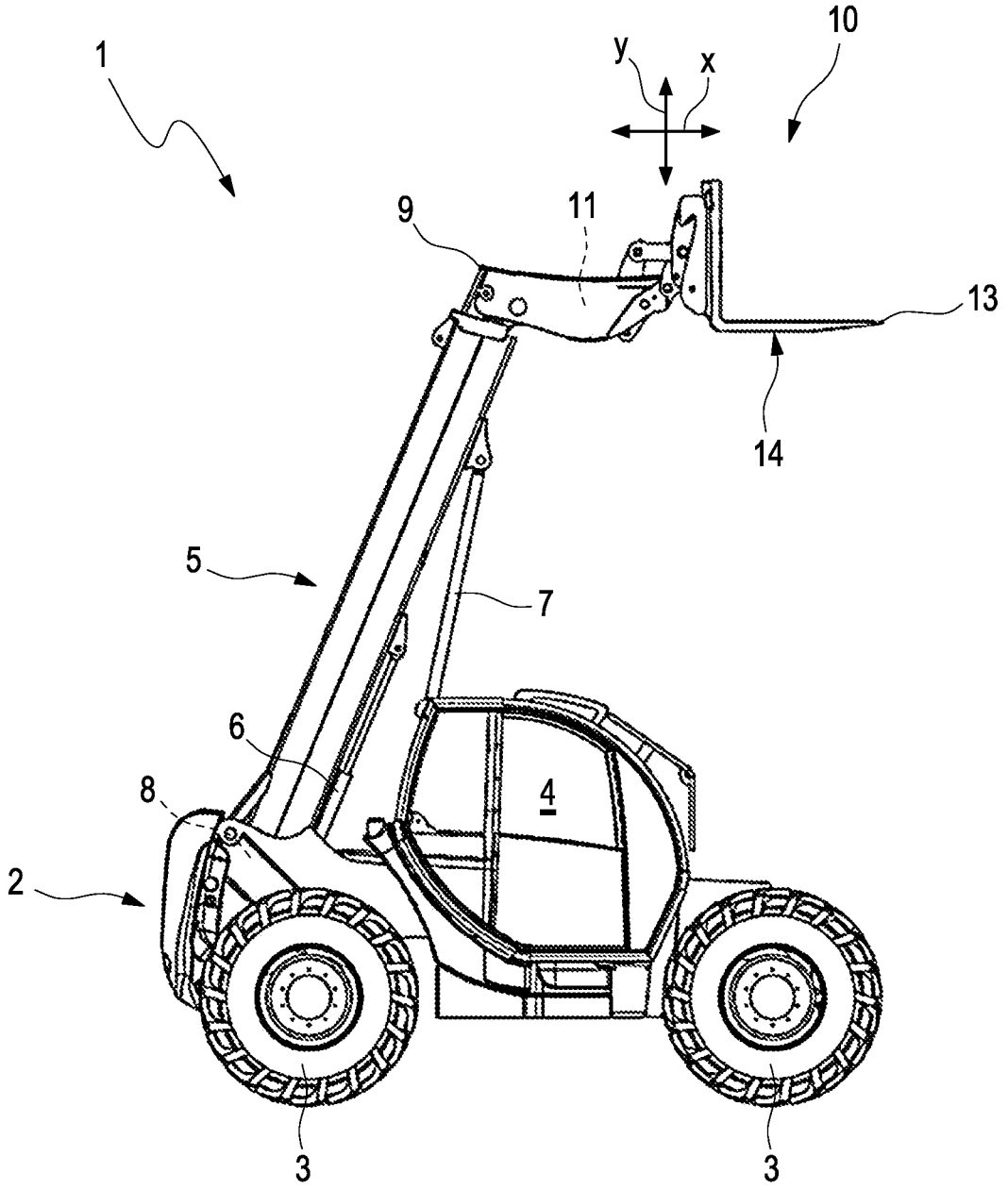
FIG. 1: a schematic view of a teleloader from a side.

FIG. 1 shows a telescopic wheel loader 1 in a schematic side view. Teleloaders 1 as such are well known in the art.

As usual, the teleloader 1 comprises a chassis 2 that is presently mounted on four wheels 3. Thanks to the wheels 3 the teleloader 1 can be moved around by an operator sitting in the driver's cab 4 of the teleloader 1. Certainly, the number of wheels 3 can vary. Also, it is possible that instead of wheels 3, crawler chains are used.

The teleloader 1 has a telescopic boom 5 that can be extended and contracted using an appropriate actuator, presently a hydraulic piston 6 (telescopic piston 6). Certainly, different types of actuators are possible as well, like a hydraulic motor that drives a cog that engages in a cog rail, just to name an example.

Furthermore, a second hydraulic piston 7 is present (angle variation piston 7) that is used for changing the angle of the telescopic boom 5 with respect to the vehicle chassis 2. For realising this, the telescopic boom 5 is movably attached to the chassis 2 using a hinge section 8.

Attached to the upper end 9 of telescopic boom 5 there is a fork 10 that can be used for picking up and putting down pallets, bales of straw, or the like. Furthermore, as it is known in the prior art as such as well, the fork 10 is connected to the upper end 9 by a tilting actuator 11 (presently actuated using a hydraulic piston as well; attitude actuator), so that the angle of the fork 10/the fork's arms 14 with respect to the chassis 2 can be varied. Thanks to this ability, pallets can be easily picked up and put down in a horizontal position (with respect to the environment). By tilting the fork 10 into an appropriate position, however, the pallet can be safely fixed on the fork 10, so that it does not fall down when the pallet is moved around by the teleloader 1.

As it is known in the art, and as it is clear from FIG. 1, an actuation of the angle variation piston 7 will result in a tilting action of the fork 10. In detail, the change of angle of telescopic boom 5 with respect to the chassis 2 is identical to the change of attitude/variation of the angle of fork 10 with respect to the ground (in case the teleloader 1 does not move). This change of attitude/variation can be either compensated by an appropriate manual operation of the operator (manual compensation), or by an automated actuation of the tilting actuator 11 (automated compensation).

However, an actuation of the angle variation piston 7 will also result in a variation of the horizontal position (x-axis) of the fork 10 (comparatively high influence), as well as in a change of the vertical position (y-axis) of the fork 10 with respect to the ground (comparatively small variation in the presently shown position of telescopic boom 5). It is presently suggested that this variation is automatically compensated (at least in part) by an appropriate actuation of the telescopic boom 5 (appropriate extension/contraction of telescopic piston 6), and/or an appropriate actuation of the wheels 3 that are presently driven by a hydraulic motor 12 (see FIG. 2).

Similarly, an extraction or contraction of the telescopic boom 5 does not only result in lifting or lowering (y-axis) the fork 10, but also in a certain forward or backward movement of the fork 10 (x-axis), as well. As it is presently suggested, this change may be compensated, at least in part, by an appropriate actuation of the wheels 3. However, it is usually preferred that the compensation of the actuator arrangement is done without actuating the wheels 3. Nevertheless, such an actuation of the wheels 3 might prove to be necessary/advantageous, at least in certain positions of the actuator arrangement.

Even further, when a tilting command is applied to the tilting actuator 11 of fork 10, this tilting command will also lead to a certain variation of the horizontal and/or vertical position of various parts of the fork 11. For the presently shown teleloader 1, usually the most problematic part is the front tip 13 of the fork arms 14 of fork 10. It is also presently suggested that any change in height (altitude; vertical position; y-axis) and/or horizontal position (x-axis) that occurs due to a tilting movement of fork 10 is automatically compensated by an appropriate actuation of the various other actuators, namely of angle variation piston 7 and/or telescopic piston 6 and/or hydraulic motor 12 (that is driving the wheels 3). Therefore, the front tips 13 of the fork arms 14 remain at an essentially identical position in space, albeit the angular position (attitude) of the fork 10 changes.

The relevance of this compensation is clear when considering the situation, where an operator has to place a pallet into a position of a shelf: he wants to change the tilted back position that is suitable for driving around into a horizontal position of the fork 10 to be able to place the pallet that is situated on the fork 10 into the shelf. So far, when commanding a tilt-forward action of the fork 10, the operator has to manually apply a lifting action and a backward driving action at the same time, so that the position of the front tip 13 of the fork 10 does not change with respect to the shelf. According to the prior art, this is quite cumbersome and requires a lot of training and experience.

Thanks to the presently suggested automatic compensation, the operator can simply command a forward tilting movement and the rest of the actuation is done automatically.

Problems might occur if an experienced user who is accustomed to compensate for any positional variations is first appointed to drive a teleloader 1 according to the present suggestion. To make the customisation process simpler for him, it is possible to define an only partial automatic correction to make the transitional period simpler for him. Therefore, the individual driver might set a 50% automatic correction at the beginning of the shift, while the next day or a week he might increase the automatic correction to 70%, just to give an example. Certainly, another operator can set any setting that he feels comfortable with.

It is further to be noted that based on the current task, even an overcorrection might be sensible. As an example, an over-correction of 120% might be advantageous, in case a pallet is placed on the fork 10, where the length of the pallet is 20% longer than the fork arms 14 lengths.

Figure 2:
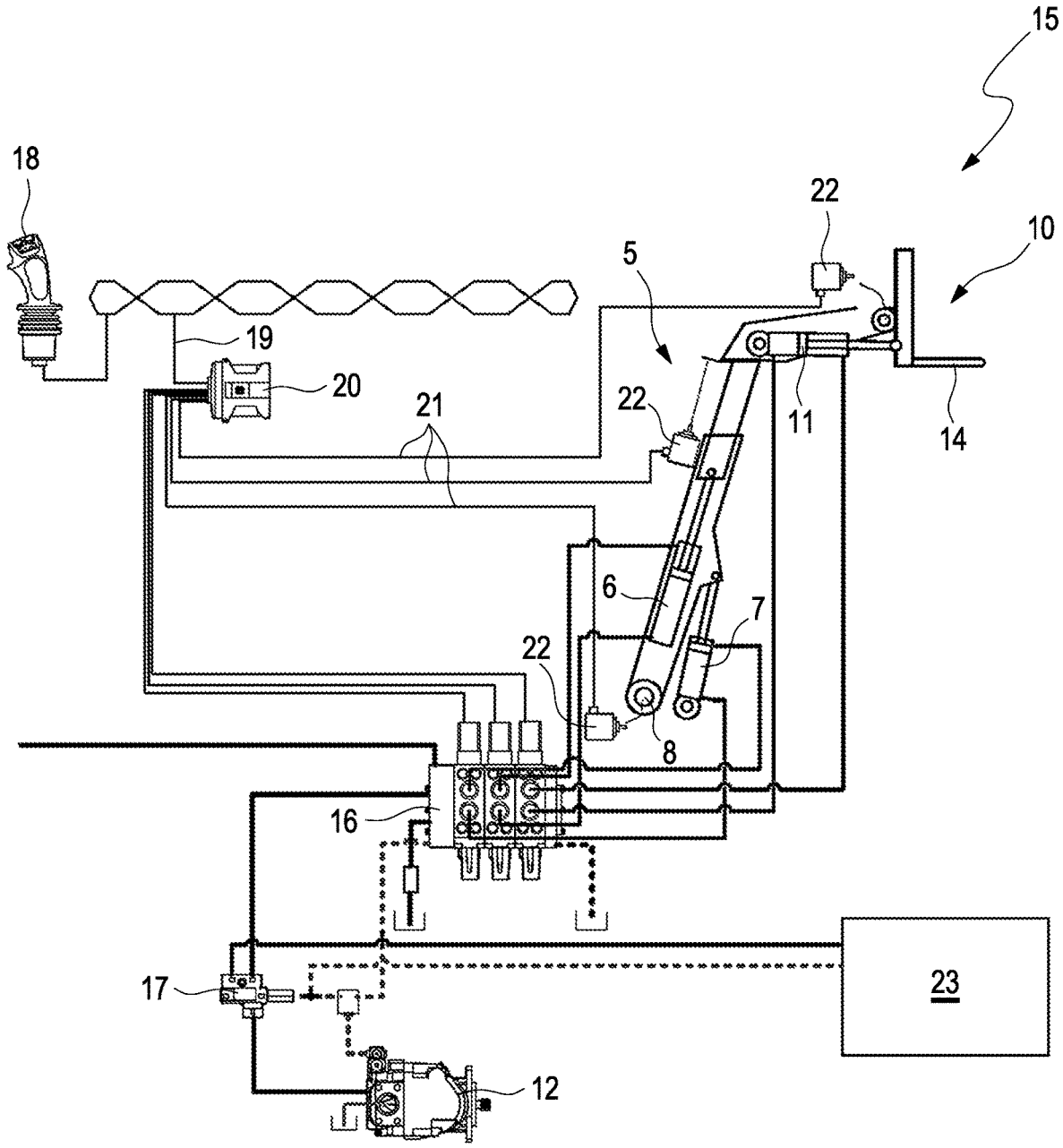
FIG. 2: the hydraulic schematics of the teleloader of FIG. 1 in a schematic drawing.

In FIG. 2, the principal hydraulic circuitry 15 is shown in a schematic drawing.

Hydraulic oil that is used for the various hydraulic services 6, 7, 11, 12, 17, 23 is supplied by a hydraulic pump 16. In the present example, the hydraulic pump 16 services telescopic piston 6, angular variation piston 7, tilting actuator 11 and hydraulic motor 12, and possibly various other systems, like a hydraulic steering system 23, that is presently connected to the hydraulic circuit by means of a priority valve 17 (just to give an example).

The input of the operator is presently made using a joystick 18 (albeit different devices can be used as well). The input data 19 is delivered to a controller 20.

Additional input data is received from various sensors 22 that are placed at appropriate positions.

Figure 3:
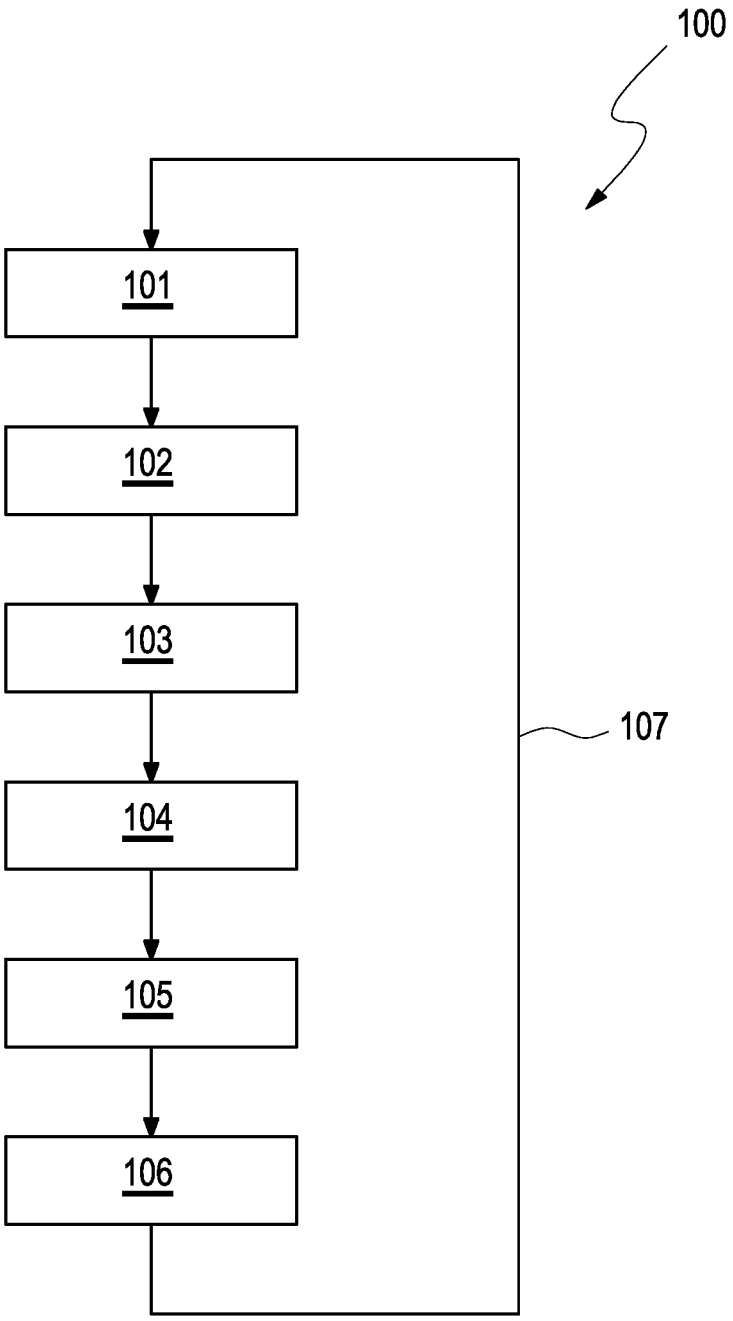
FIG. 3: the schematics of a control method for the teleloader according to FIGS. 1 and 2.

The operator input data 19 is read in 101 by the controller 20 (see also flowchart diagram 100 of FIG. 3).

Additionally, additional input data 21 is read in 102 by the controller 20.

Based on the various input data 19, 21, and based on additional data that is stored in the controller (representing the mechanical design of the teleloader 1, preferences of the present operator and the like), the controller first of all calculates 103 the side effects that come along with a certain actuation command. As an example, in this step the controller 20 considers a tilting command for tilting the fork 10 and calculates the effect this will have on the horizontal (x-axis) and the vertical (y-axis) position of the front tip 13 of the fork 10.

Next, the controller 20 calculates 104 appropriate compensation signals that will be applied to the various actuators 6, 7, 11, 12, so that no side-effects will occur.

Possibly, the size of the control signals will be artificially increased or decreased (i.e. the correction signals will be adapted 105), in case the operator, the manufacturer of the vehicle, or any machine shop or employer has implemented this feature.

Consequently, the controller 20 will output the appropriately corrected actuation signals 106.

After this, the program jumps back 107 and the flowchart 100 is repeated for a new cycle.

Figure 4:
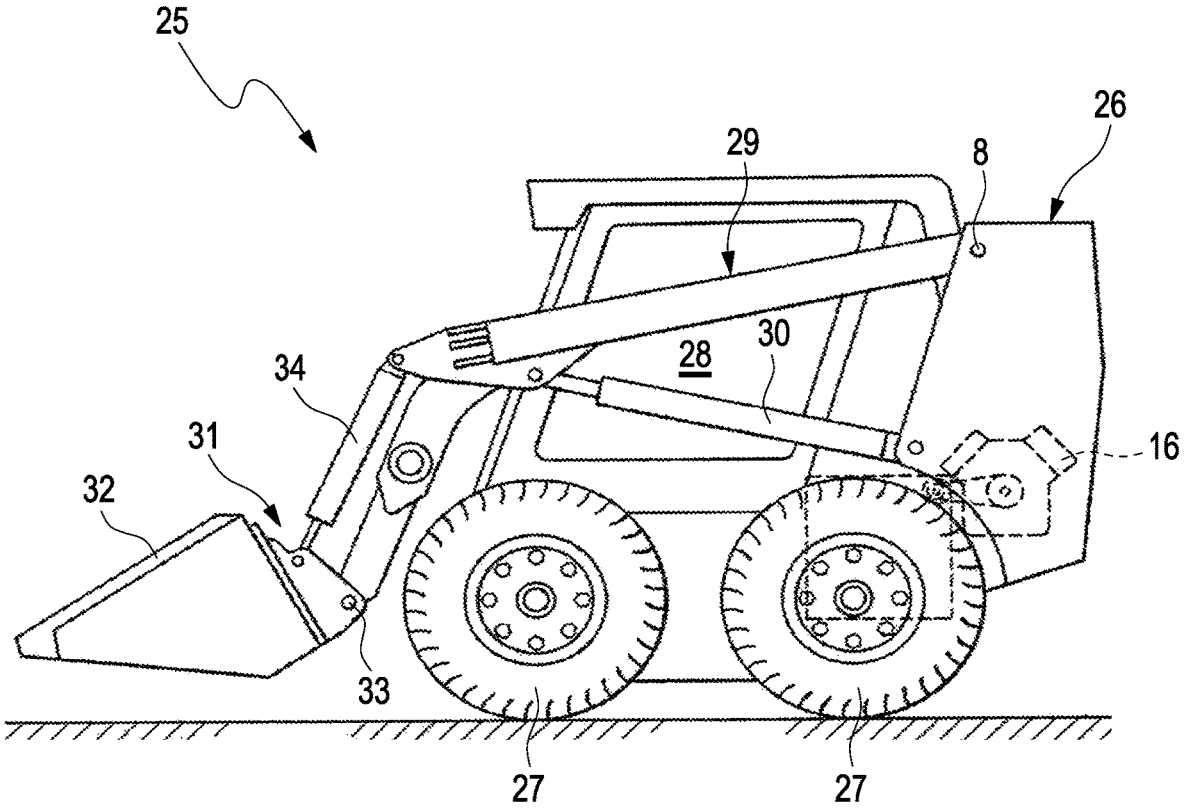
FIG. 4: a schematic side view of a bucket loader.

To complete the description, in FIG. 4 another type of machinery is shown, namely a bucket loader 25 in a schematic side view. In the presently shown detailed embodiments, similar devices are using identical reference numbers, if the function of the respective devices are identical, or at least highly similar.

Similar to the teleloader 1, the presently shown bucket loader 25 has a chassis 26 that is mounted on wheels 27 (presently four wheels 27). The operator is sitting in the driver's cab 28.

The bucket loader 25 shows a pivot capable & arranged boom 29. The boom 29 is attached to the chassis 26 by the hinge section 8.

The boom 29 can be raised or lowered using a hydraulic piston 30 (angle variation piston 30). It is to be noted, that different types of actuators can be used as well.

At the opposite side of the hinge section 8 (front end 31 of boom 29), presently a bucket 32 is attached. Presently, the bucket 32 is also rotatably attached to the boom 29, using a hinge 33. The attitude of the bucket 32 (angle of the bucket 32 with respect to the ground) can be varied by an attitude actuator 34, which is presently also designed as a hydraulic piston 34.

The previously said can be applied mutatis mutandis to the presently suggested bucket loader 25 as well. Doing this, the same objectives, advantages and features can be realised as well, at least in analogy.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method of operating an actuator arrangement comprising at least two types of actuators effectuating different types of movement of a connected device to be actuated, where a change of attitude and/or position of the connected device has an influence on the position of at least a defined part of the connected device, wherein the two types of actuators are actuated in an automated way to at least partly compensate for the change of position of the defined part of the connected device, when changing the attitude and/or position of the connected device, at least for a certain range of movement.

2. The method according to claim 1, wherein the attitude of the connected device is primarily determined by a setting of an attitude actuator, wherein the setting of the attitude actuator usually has an influence on the position of the defined part of the connected device as well, and wherein the attitude actuator is one of the two types of actuators.

3. The method according to claim 2, wherein at least some of said actuators are hydraulic actuators and/or in that at least one of said actuators is a driving actuator of a vehicle.

4. The method according to claim 2, wherein the connected device is a shovel, a bucket, a fork, and/or a grasping device and/or in that the actuator arrangement forms part of a shovel dozer, a wheel loader, a telescopic wheel loader, a teleloader, a backhoe loader, an excavator and/or a forklift truck.

5. The method according to claim 2, wherein the defined part of the connected device is located near a bottom side of the connected device and/or is located near a front section of the connected device, opposite of a connection section and/or a hinge device of the connected device and the actuator arrangement and/or is located with a displacement from a front section of the connected device, opposite of a connection section and/or a hinge device of the connected device and the actuator arrangement and/or is located with a displacement from the connection section and/or the hinge device of the connected device and the actuator arrangement.

6. The method according to claim 2, wherein the defined part of the connected device is chosen in dependence of the connected device.

7. The method according to claim 1, wherein at least some of said actuators are hydraulic actuators.

8. The method according to claim 7, wherein the connected device is a shovel, a bucket, a fork, and/or a grasping device and/or in that the actuator arrangement forms part of a shovel dozer, a wheel loader, a telescopic wheel loader, a teleloader, a backhoe loader, an excavator and/or a forklift truck.

9. The method according to claim 7, wherein the defined part of the connected device is located near a bottom side of the connected device and/or is located near a front section of the connected device, opposite of a connection section and/or a hinge device of the connected device and the actuated arrangement and/or is located with a displacement from a front section of the connected device, opposite of a connection section and/or a hinge device of the connected device and the actuator arrangement and/or is located with a displacement from the connection section and/or the hinge device of the connected device and the actuator arrangement.

10. The method according to claim 7, wherein the hydraulic actuators are hydraulic pistons and/or hydraulic motors.

11. The method according to claim 1, wherein the connected device is a shovel, a bucket, a fork, and/or a grasping device and/or in that the actuator arrangement forms part of a shovel dozer, a wheel loader, a telescopic wheel loader, a teleloader, a backhoe loader, an excavator and/or a forklift truck.

12. The method according to claim 11, wherein the defined part of the connected device is located near a bottom side of the connected device and/or is located near a front section of the connected device, opposite of a connection section and/or a hinge device of the connected device and the actuator arrangement and/or is located with a displacement from a front section of the connected device, opposite of a connection section and/or a hinge device of the connected device and the actuator arrangement and/or is located with a displacement from the connection section and/or the hinge device of the connected device and the actuator arrangement.

13. The method according to claim 1, wherein the defined part of the connected device is located near a bottom side of the connected device and/or is located near a front section of the connected device, opposite of a connection section and/or a hinge device of the connected device and the actuated actuator arrangement and/or is located with a displacement from a front section of the connected device, opposite of a connection section and/or a hinge device of the connected device and the actuator arrangement and/or is located with a displacement from the connection section and/or the hinge device of the connected device and the actuator arrangement.

14. The method according to claim 13, wherein the defined part of the connected device is chosen in dependence of the connected device.

15. The method according to claim 1, wherein a range for corrections and/or a direction of corrections is limited for certain actuators, and/or in that corrections of at least certain actuators are only allowed under certain conditions and/or on condition of an express clearance and/or on condition of a certain sensor input and/or on condition of a certain data output and/or in certain areas and/or locations.

16. The method according to claim 1, wherein the method is applied on request only, in particular on request of an operator and/or in that the method is deactivated on request, in particular on request of an operator.

17. The method according to claim 1, wherein the main input is made by an operator, in particular a human operator and/or an autonomous driving logic, wherein the main input is modified using a method according to claim 1.

18. The method according to claim 1, wherein the defined part of the connected device is chosen in dependence of the connected device.

19. The method according to claim 1, wherein at least one of said actuators is a driving actuator of a vehicle.

20. A controller device that is designed and arranged to perform a method of operating an actuator arrangement comprising at least two types of actuators effectuating different types of movement of a connected device to be actuated, where a change of attitude and/or position of the connected device has an influence on the position of at least a defined part of the connected device, wherein the two types of actuators are actuated in an automated way to at least partly compensate for the change of position of the defined part of the connected device, when changing the attitude and/or position of the connected device, at least for a certain range of movement.

21. An actuator arrangement, comprising a plurality of actuators and a controller device according to claim 20, wherein the plurality of actuators include the two types of actuators.

22. A working vehicle, comprising the actuator arrangement according to claim 21.

23. The controller device according to claim 20, wherein the controller device is an electronic controller device.

* * * * *